United States Patent [19]

Schuermann et al.

[11] 3,991,494

[45] Nov. 16, 1976

[54] CONVEYOR ATTACHMENT FOR SPOILS REMOVAL FROM A TRENCH DIGGING MACHINE

[75] Inventors: Kenneth W. Schuermann; David R. Bazzell, both of Perry, Okla.

[73] Assignee: Charles Machine Works, Inc., Perry, Okla.

[22] Filed: Jan. 23, 1975

[21] Appl. No.: 543,470

[52] U.S. Cl. ..... 37/90; 37/102; 37/112.

[51] Int. Cl.[2] ..... E02F 5/06

[58] Field of Search ..... 37/86, 90, 102, 112

[56] References Cited

UNITED STATES PATENTS

| | | | |
|---|---|---|---|
| 1,280,701 | 10/1918 | French | 37/90 |
| 2,710,466 | 6/1955 | Chartier | 37/90 |
| 2,747,307 | 5/1956 | Griffin | 37/90 |
| 3,015,175 | 1/1962 | Smith | 37/90 X |
| 3,057,089 | 10/1962 | Kiechel et al. | 37/90 |

*Primary Examiner*—Stephen C. Pellegrino

[57] ABSTRACT

A trench digging machine is supplemented by a spoils removal conveyor mountable on a frame intermediate the trench digger and the powered vehicle which carries the digger so as to be readily removable and replaced by auger spoils removal for moving spoils laterally from the trench being dug by the trench digger.

9 Claims, 6 Drawing Figures

FIG. 3
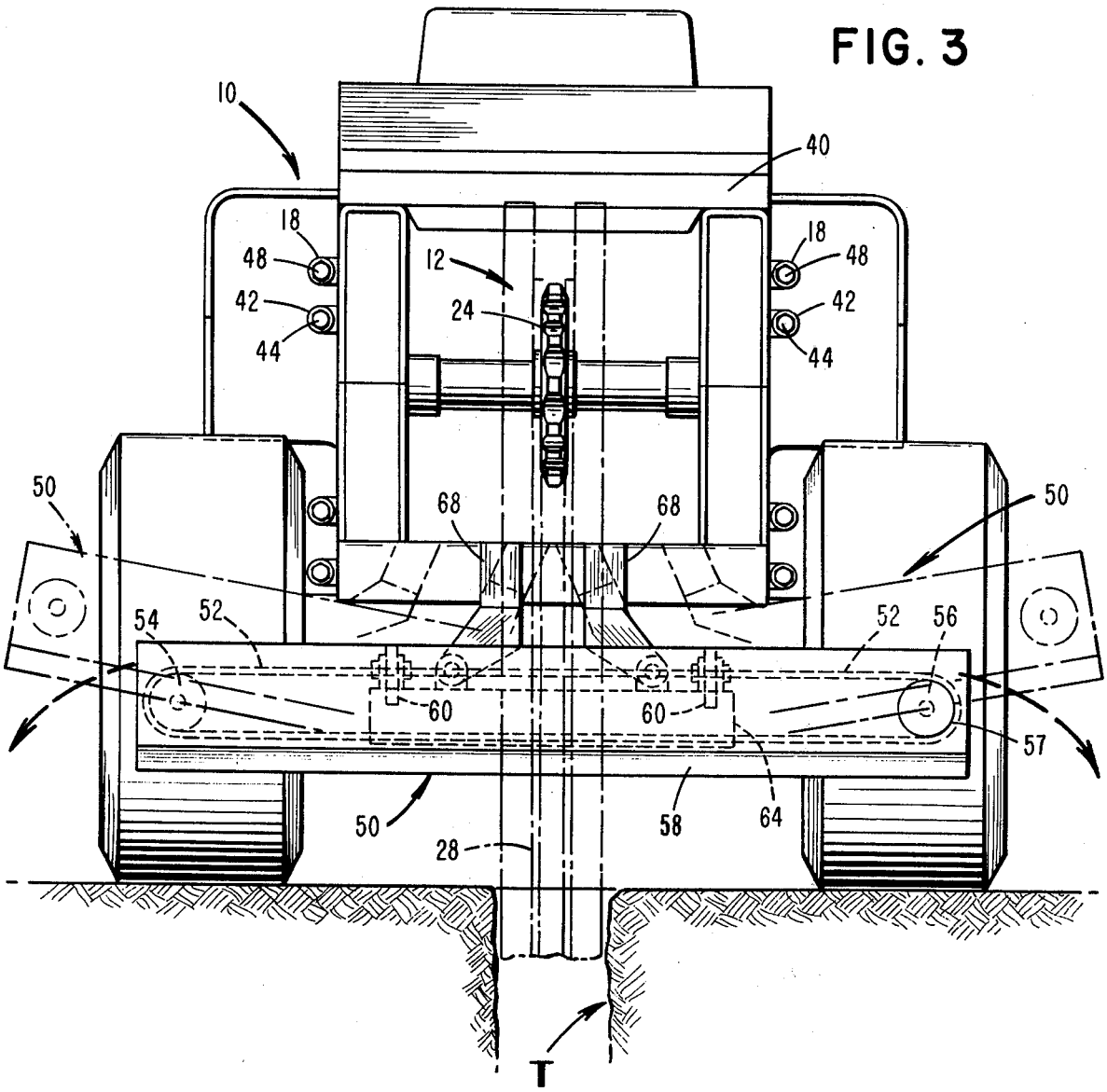
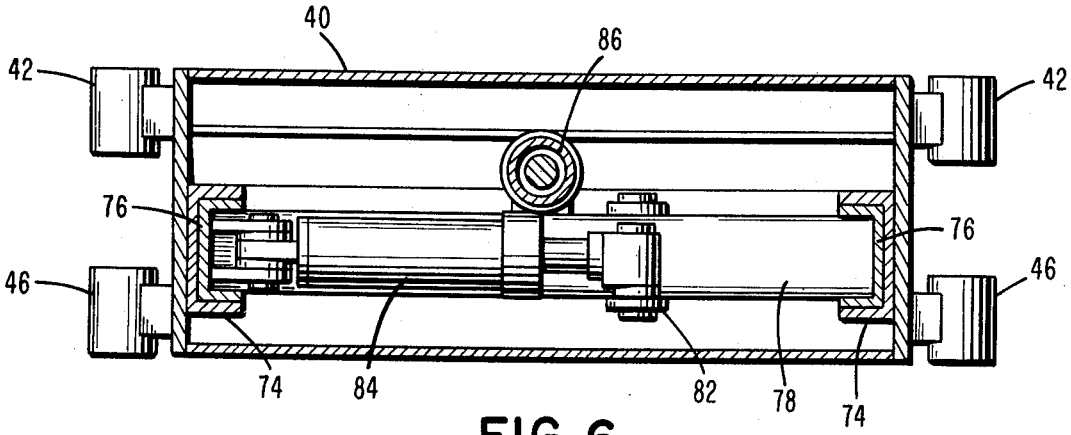
FIG. 6

CONVEYOR ATTACHMENT FOR SPOILS REMOVAL FROM A TRENCH DIGGING MACHINE

BACKGROUND OF THE INVENTION

This invention relates to trench digging machines and, more specifically, to the removal of earthen type spoils brought from a trench by a trench digger to discharge such spoils laterally remote from the trench being dug.

In the art of trench digging machines, one form of trencher or trench digger employs a digger chain which is guided around the periphery of an elongated boom and driven by powered means on the vehicle which supports the trench digger. The boom carrying the chain is brought into engagement with the ground and by driving the digging chain around the boom periphery a trench is formed in the ground with the earthen type spoils brought out of the trench by the digging chain action requiring their removal to one or the other or both sides laterally of the trench being dug.

The prior art has recognized two primary types of spoils removal approaches, one employing rotating augers extending transversely to the plane of movement of digging chain on the boom and the other employing belt type conveyors to receive the spoils and transport them laterally to one or the other or both sides of the trench being dug. In either approach, the completed trench is left with an elongated pile of earthen type spoils extending parallel to the trench, available to be reintroduced into the trench once the desired pipe, cable, etc. has been placed in the bottom of the trench and is ready to be covered over.

There are different requirements for certain trenching operations. Whereas an auger type spoils removal approach is relatively simple and its driving power readily available from the drive for the digging chain, 29 Code of Federal Regulations Part 1926.651(i)$_1$ requires that the spoils be located more precisely, at least two feet, from the edge of the trench. A rotatable spoils auger is not as well adapted to achieving this more precise disposal from the edge of the trench and thus, a coveyor spoils removal system makes such precise lateral spacing simpler to accomplish. However, the cost of purchase and maintaining both a trench digger with an auger and one with a conveyor type spoils removal system adds substantially and prohibitively to the economics of being able to perform trenching operations within the various regulations for trenching and spoils disposal laterally at greater or lesser distances from the trench being dug.

THE PRESENT INVENTION

The disadvantages of having to maintain two trench diggers, one with an auger spoils removal system and the other with a conveyor spoils removal system, are overcome by the present invention. The invention provides a frame adapted to be separably positioned intermediate the powered vehicle and the trench digger. The frame carries a spoil removal conveyor extending transversely of the digger and vehicle disposed to receive earthen type spoils removed by the digger and convey them laterally remote from the trench being dug. When desired, the frame carrying the spoils removal conveyor or simply the spoils conveyor may easily be removed from between the vehicle and trench digger with one or more spoils removal augers added to the driving shaft means for the digging chain sprocket, giving the trench digger an auger spoils removal capability.

Accordingly, the principal object of this invention is to provide a trench digging machine having readily available alternate capability for spoils removal laterally of the trench being dug by either auger or conveyor means.

Another object of the invention is to provide a separable spoils removal conveyor carried by a frame where the conveyor is readily shiftable laterally of the frame to achieve the desired disposal of the spoils at a greater or lesser distance laterally of the trench being dug.

Another important object of this invention is to provide an improved trench digging machine having a separable frame positioned between the vehicle and trench digger, the frame carrying a spoils removal conveyor which may be raised and lowered relative to the frame to dispose the conveyor at the desired optimum elevation for receiving the spoils from the trench digger.

Another object of this invention is to provide a conveyor attachment frame for a trench digger wherein the frame carries a conveyor which is shiftable laterally or vertically as desired relative to the frame to position the conveyor for desired disposal of earthen type spoils received from the trench digger and wherein such adjustability of the conveyor relative to the frame is easily achieved by hydraulically energized components.

This invention is designed to accomplish the above and related end results, and comprises elements and features hereinafter set forth. An illustrative embodiment of the present invention is described below in relation to the accompanying drawings of the same. It is to be understood that these illustrative embodiments suggest only a few of the various ways in which the principals of this invention may be employed.

BRIEF DESCRIPTION OF THE DRAWINGS

FIG. 3 is a rear elevational view of the trench digging machine shown in FIG. 2;

FIG. 6 is a sectional view taken on line 6—6 of FIG. 4.

DESCRIPTION OF AN ILLUSTRATIVE EMBODIMENT

Figure 1:
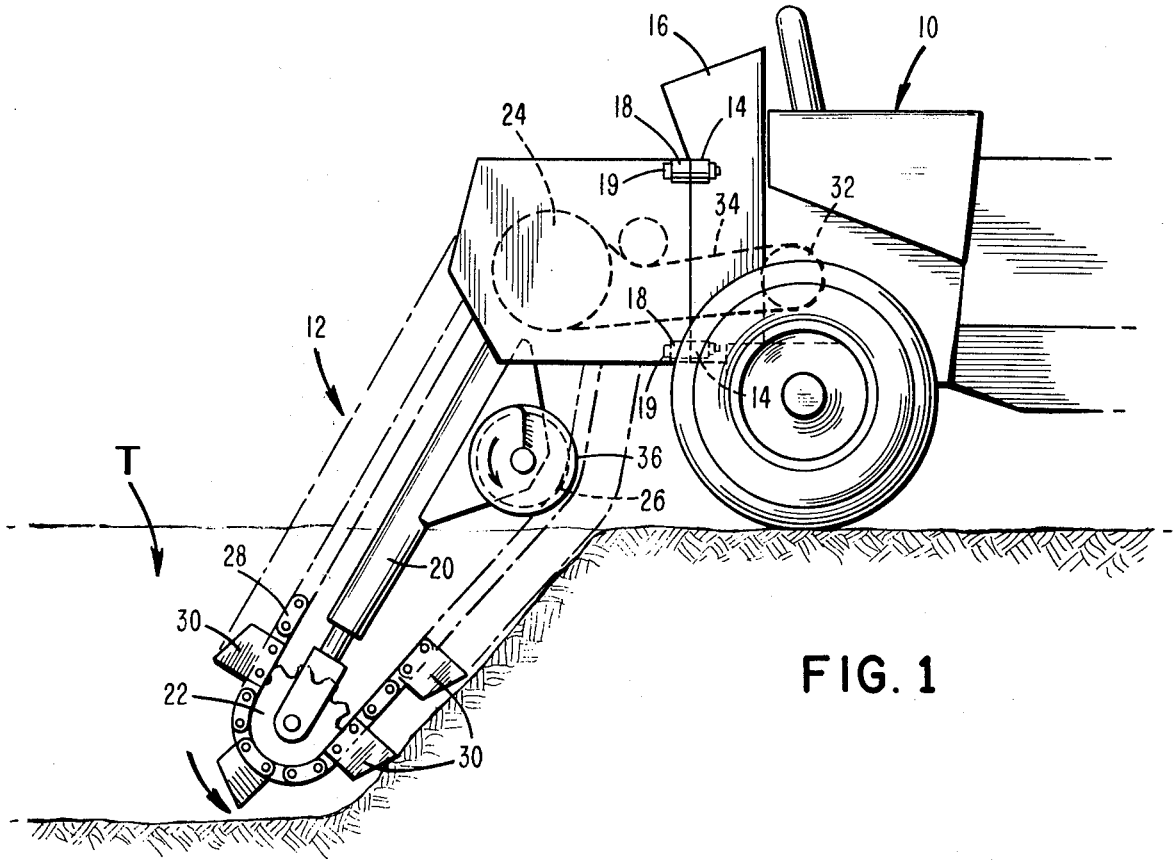
FIG. 1 is a side elevational view of a powered vehicle carrying a trench digger provided with an auger type spoils disposal system.

Referring to FIG. 1, a portion of a powered vehicle 10, adapted to mount and drive a trench digger 12 at the rear of the vehicle is illustrated, this vehicle being illustrated as being wheel supported to draw the trench digger along behind the vehicle in producing a trench T.

The trench digger 12 is mounted on the rear of vehicle 10 by means of bosses 14 on the rear mounting plate 16 of the vehicle which match up with bosses 18 on the mounting end of the digger 12. Nut and bolt connectors 19 engaging the matching bosses secure the digger on the vehicle.

The trench digger 12 has a boom 20 carrying a sprocket 22 at its lower end, a driven sprocket 24 adjacent its upper end and a sprocket 26 intermediate its length. A digging chain 28, carrying digging elements 30 spaced therealong, is trained around the sprockets 22, 24 and 26 to be guided thereby when driven to produce the desired trench. The vehicle 10 has a driver sprocket 32 which is powered by the power source on the vehicle. An endless drive chain 34 passes around driver sprocket 32 and a driven sprocket, with same axis of rotation as driven sprocket 24, on the trench digger 12 whereby the digging chain 28 is driven to dig the trench.

In the form shown in FIG. 1, the shaft carrying sprocket 26, which engages and is driven by chain 28, supports and drives a spoils removal auger 36. Thus, when the digging chain 28 is in operation by being driven by a sprocket 24 the sprocket 26 likewise rotates auger 36 so that the earthen type spoils removed by the digging chain in forming the trench are propelled laterally by the auger 36 away from the dug trench and disposed in a pile formed longitudinally parallel to the trench being dug.

Figure 2:
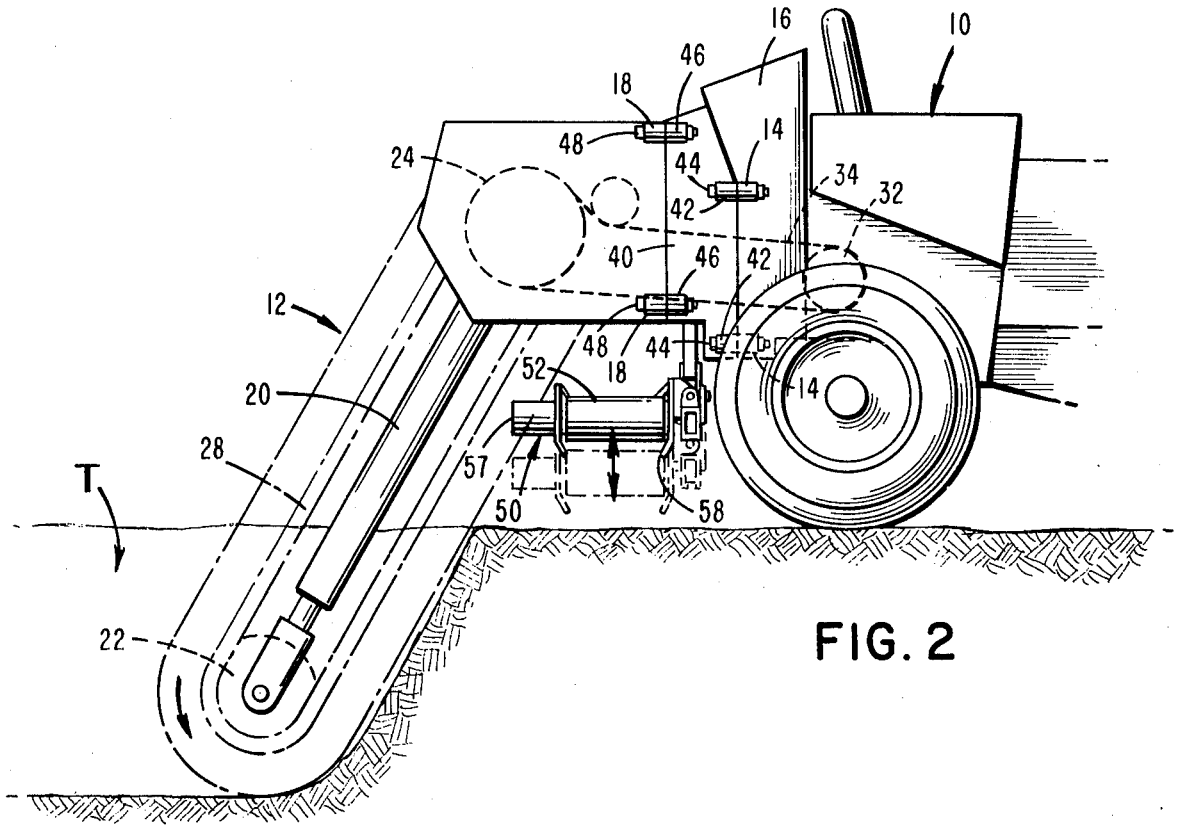
FIG. 2 is a side elevational view of powered vehicle having a trench digger with a conveyor attachment frame carrying a spoils removal conveyor mounted intermediate the vehicle and trench digger in accordance with the instant invention.

FIG. 2 illustrates the conveyor attachment frame of this invention which is employed to provide a conveyor type spoils disposal system for use with the trench digger as an alternative to and replacement for the auger type spoils removal provided by auger 36 in the embodiment shown in FIG. 1. In FIG. 2, the vehicle 10 and trench digger 12 are the same as those shown in FIG. 1, although the digger 12 has been altered and adjusted to remove the auger 36 with the boom 20 being lengthened by adjustment to carry the digging chain in an elongaged path with the two reaches of the chain being parallel to one another between the lower sprocket and upper driven sprocket. A driving chain 34 engages with the driver sprocket 32 on the vehicle and with the driven sprocket on the digger 12 to achieve the same driving action for trench digging as accomplished by chain 34 in the embodiment shown in FIG. 1.

In the embodiment of FIG. 2, a frame 40 is positioned intermediate the rear mounting plate 16 of the vehicle and the mounting end of the trench digger 12. Frame 40 has bosses 42 which mate with the bosses 14 on the mounting plate 16 of the vehicle 10. As in the FIG. 1 construction, nut and bolt connectors 44 serve to fasten the frame 40 to the vehicle by cooperating with the mating bosses 14 and 42. Likewise, the rear portion of the frame 40 is provided with bosses 46 which align with the bosses 18 on the digger 12 and nut and bolt connectors 48 are used to securely fasten the digger 12 to the rear of frame 40.

The frame 40 supports a spoils removal conveyor 50 in a manner to render it vertically and laterally adjustable, as will be explained, so that earthen type spoils removed from the trench by the digger 12 may be effectively picked up by the conveyor and carried laterally of the trench for the desired distance to form the spoils pile spaced along one side or the other of the trench.

Conveyor 50 comprises an endless belt 52 which is trained over rollers 54 and 56 supported at opposite ends of conveyor framework 58 (FIG. 3). The rollers 54 and 56 may each be driven by a hydraulic motor mounted so as to drive the respective rollers 54 and 56 by means of hydraulic pressure linss (not shown) leading to and from the motors. Although an individual motor, hydraulic or electric powered, may be provided for each of rollers 54 and 56, a single motor 57 connected to drive only roller 56 is suitable and is illustrated on the drawings (FIGS. 2 and 3). In any event, it is desired to have the one or two motors reversible to enable driving belt 52 in either direction so that the earthen type spoils can be discharged to either side of the trench being dug as desired.

Framework 58 of the conveyor 50 is connected to the frame 40 through a series of linkages which permit its vertical and lateral adjustment relative to frame 40 as well as permitting framework 58 of conveyor 50 to swing out of the way in the event of an obstacle, such as a rock, etc. being encountered as the vehicle 10 moves forward in the trenching operation. Thus, framework 58 has a pair of spaced ears 60 affixed thereto which are pivotally connected by stub pins 62 to a box member 64 by means of retainers 66 on box member 64. In turn, box member 64 is pivotally connected to legs 68 by pins 70 engaging with tabs 72 suitably secured to the exterior walls of box member 64..

The vertical sidewalls of frame 40 carry guide channels 74 on the interior thereof in which are nested slides 76. Transverse member 78 extends between and is secured to the slides 76. The upper ends of legs 68 are connected by pins 80 to transverse member 78 so that vetical movement of member 78 and slide 76 is effective in raising and lowering box member 64 and, in turn, raising and lowering the spoils removal conveyor 50. One of the legs 68 has an upper extension 82 extending above it mounting pin 80 which connects it to transverse member 78.

Figure 4:
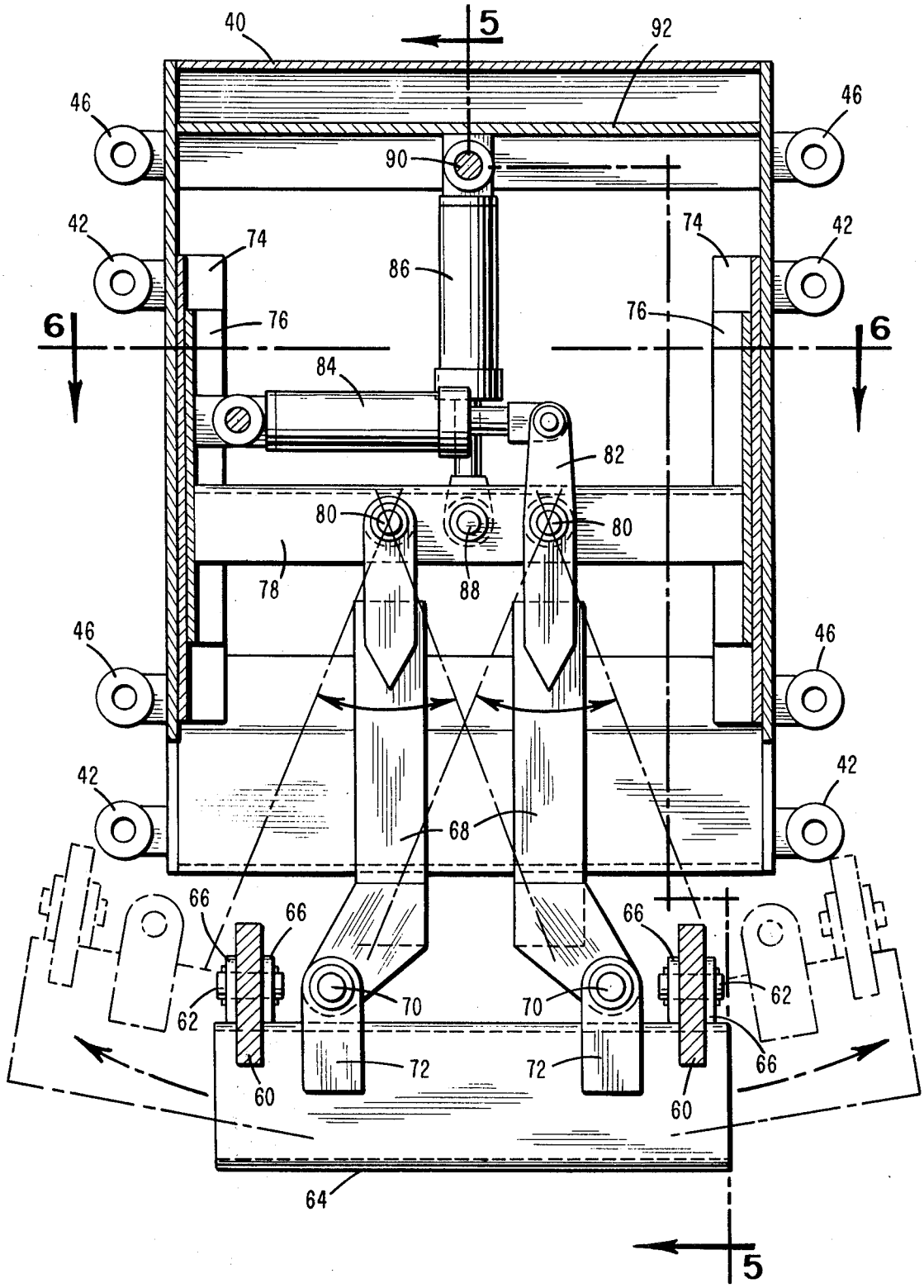
FIG. 4 is a sectional view through the conveyor attachment frame showing the adjustable supports for the spoils removal conveyor.
Figure 5:
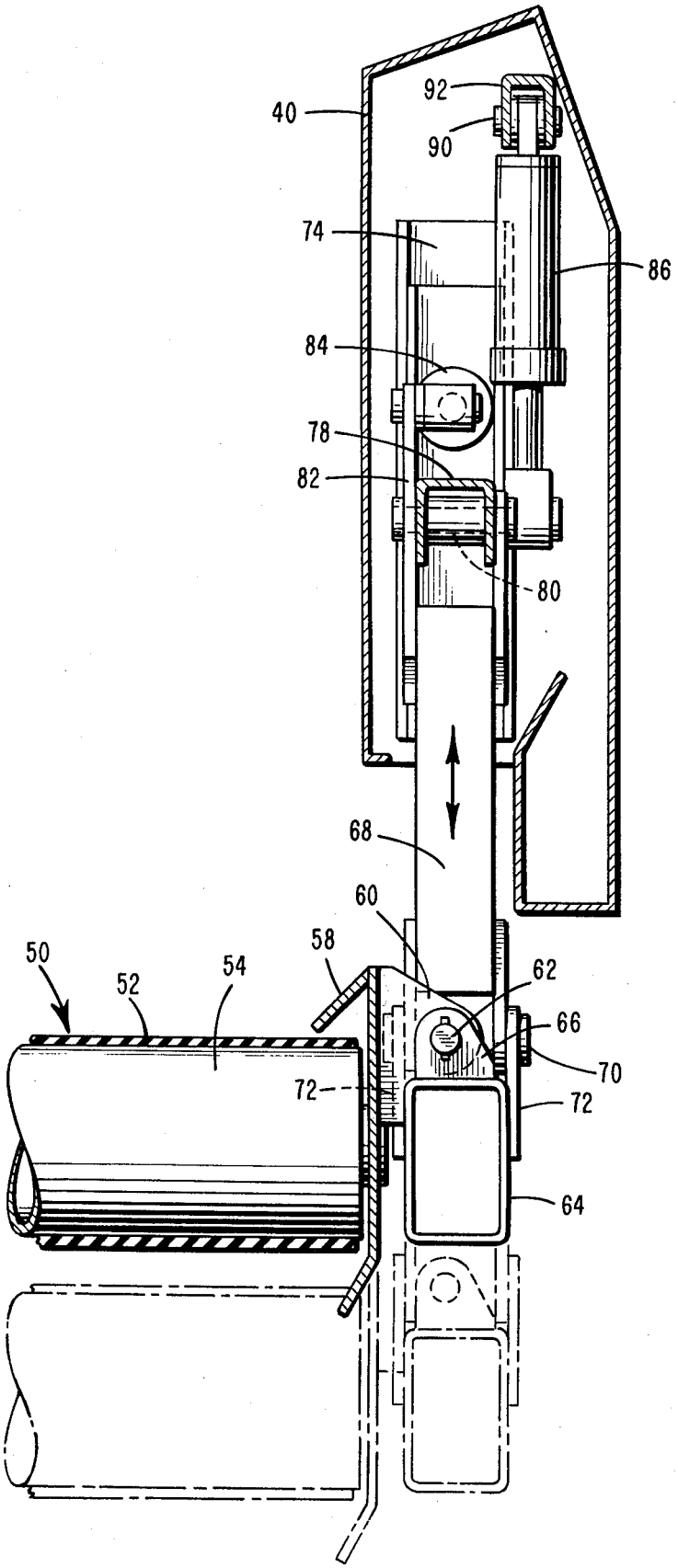
FIG. 5 is a sectional view taken on line 5—5 of FIG. 4.

A hydraulic cylinder actuator 84 is pin connected to the upper end of extension 82 and pivotally secured at its opposite end to one of the slides 76 as shown in FIG. 4. Extension or retraction of actuator 84 acts through extension 82 to swing box member 64 and spoils removal conveyor 50 carried thereby laterally to one or the other sides of the trench digger 12 and vehicle 10 as shown in phantom on FIG. 4. By this means, the extent to which the spoils removal conveyor 50 extends to the side of the trench being dug may be adjusted as desired. In FIG. 3 the conveyor 50 is shown in its centered position. By driving the conveyor belt 52 in one directionor the other the spoils may be discharged either to the right or to the left of the trench T, as shown in FIG. 3. By extending the actuator 84, conveyor 50 will be caused to swing to the left (FIG. 3) to discharge the spoils further to the left of the trench T when motor 57 is energized to drive belt 52 counterclockwise. Correspondingly, by retracting actuator 84 conveyor 50 will be caused to swing to the right and with an appropriate driving direction of conveyor belt 52 the spoils may be discharged further or nearer to trench T.

To raise and lower the vertical height of conveyor 50, a hydraulically extensible actuator 86 is pin connected at 88 to transverse member 78 carried by slides 76. The opposite end of actuator 86 is pin connected at 90 to an internal frame element 92 of frame 40. Obviously, by extending or retracting actuator 86, the conveyor 50, carried by box member 64, may be raised and lowered to the desired elevation to the trench digger 12 for best reception of the spoils from the digger.

The hydraulic connections to the motor 57 driving conveyor 50 and to actuators 84 and 86 are not illustrated to simplify illustrating the structure of the invention. It will, of course, be appreciated that appropriate connections to and from control valves located conveniently available on the vehicle 10 will be provided as recognized to those skilled in the art.

It will be noted that the stub connecting pins 62, by being disposed with their axes transverse to the direction of movement of the vehicle 10 and trench digger 12, enable the conveyor 50 carried by box member 64 to easily swing out of the way should forward movement of the vehicle and digger bring the conveyor 50 into contact with a rock or other obstruction located in the vehicle's path of movement. Likewise, the lateral shiftability of the legs 68, carrying the conveyor 50 on box member 64, permit the conveyor to be shifted further to one side or the other depending upon the distance to which the spoils are to be discharged on one side or the other of the trench T. Also it will be noted that if legs 68 are non-parallel as shown in FIG. 4, that when the conveyor 50 swings to one side or the other the angle of elevation of the discharged spoils increases so that the lateral distance which the spoils will travel is correspondingly increased. Obviously, the motor 57 driving the conveyor belt 52 will be energized in the appropriate direction depending upon which side of the trench the spoils are to be discharged. Also raising and lowering of the conveyor 50 may be effected to receive and discharge away from the trench the spoils deposited thereon from the digging chain 28 of the trencher when it is operating to dig the trench.

It will be appreciated that the embodiment of this invention herein described is only illustrative. It represents a suggested form of a trench digging machine for achieving the objects and goals initially set forth. Accordingly, it will be understood that the preferred embodiment set forth is not intended to exclude but rather to suggest such other modifications and adaptations as fall within the spirit and scope of this invention, as embraced within the appended claims.

We claim:

1. A trench digging machine comprising:

a powered vehicle having thereon support means for detachably mounting a trench digger on said vehicle;

a conveyor attachment frame having separate connection means at spaced positions on said frame, one of said connection means matingly cooperating with said support means to separably secure said frame on said vehicle by said support means;

a trench digger having mounting means which is removably fastened to said attachment frame by said mounting means matingly cooperating with the other of said connection means on said attachment frame to physically dispose said frame between said vehicle and said digger, said mounting means being matingly cooperable with said support means for directly separably mounting said digger on said vehicle by connection of said mounting means to said support means in the absence of said attachment frame;

a spoils removal conveyor carried by said frame, said conveyor being positioned on said frame to extend transversely of the digger and be disposed to receive earthen type spoils removed by said digger and convey them laterally remote from the trench being dug; and said digger having attaching means thereon to detachably mount a spoils removal auger on said digger for the auger to move spoils laterally from the trench being dug when said spoils removal conveyor is not present.

2. A trench digging machine as recited in claim 1 wherein said spoils removal conveyor is disposed lower than said conveyor equipment frame and is adjustably mounted to be laterally and vertically movable relative to said frame.

3. A trench digging machine as recited in claim 2 wherein said frame carries generally vertical guide members thereon, and said spoils removal conveyor is mounted to be guided by said guide members to provide said vertical adjustability relative to said frame.

4. A machine as recited in claim 2 wherein said lateral and vertical adjustability of said spoils removal conveyor is controlled by hydraulic actuator means controllable from said powered vehicle and connected between said frame and said conveyor.

5. A machine as recited in claim 1 wherein said support means, said separate connection means and said mounting means are all of matching and similar construction.

6. A trench digging machine comprising:

a powered vehicle having thereon support means for detachably mounting a trench digger on said vehicle;

a conveyor attachment frame having separate connection means at spaced positions on said frame, one of said connection means matingly cooperating with said support means to separably secure said frame on said vehicleby said support means, said frame having thereon conveyor attaching means for a spoils removal conveyor;

a trench digger having mounting means which is removably fastened to said attachment frame by said mounting means matingly cooperating with the other of said connection means on said attachment frame to physically dispose said frame between said vehicle and said digger, said mounting means being matingly cooperable with said support means for directly detachably mounting said digger on said vehicle by connection of said mounting means to said support means in the absence of said attachment frame;

a spoils removal conveyor carried on said conveyor attaching means on said frame, said conveyor being positioned on said frame to extend transversely of the digger and be disposed to receive earthen type spoils removed by said digger and convey them laterally remote from the trench being dug; and said digger having attaching means thereon to detachably mount a spoils removal auger on said digger for the auger to move spoils laterally from the trench being dug when said spoils removal conveyor is not present.

7. A trench digging machine as recited in claim 6 wherein said conveyor attaching means iancludes a movable support for said conveyor to change the lateral extent of projection of said conveyor relative to said digger, and hydraulic control means connected to said movable support to effect said change in the lateral extent of projection.

8. A trench digging machine as recited in claim 6 wherein said conveyor attaching means includes carrier means providing an axis extending transversely relative to said vehicle and digger, and said conveyor being supported on said carrier means so that said conveyor may yield and move free of interference with an obstacle in the path of movement of said vehicle.

9. A machine as recited in claim 6 wherein said conveyor attaching means comprises a pair of leg members pivotally connected at their lower ends to said spoils removal conveyor and supported pivotally relative to said frame at their upper ends, and means connected to said leg members to swing them laterally to effect lateral adjustment of the distance at which said conveyor extends from said trench digger for discharge of the spoils.

* * * * *